US008376506B2

(12) United States Patent
Shepherd et al.

(10) Patent No.: US 8,376,506 B2
(45) Date of Patent: Feb. 19, 2013

(54) DROP DETECTION

(75) Inventors: Matthew A Shepherd, Vancouver, WA (US); Alexander Govyadinov, Corvallis, OR (US); Erick B Kinas, Camas, WA (US); Paul Richards, Corvallis, OR (US); Tom Deskins, Albany, OR (US); Steven H Walker, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 484 days.

(21) Appl. No.: 12/511,583

(22) Filed: Jul. 29, 2009

(65) Prior Publication Data

US 2010/0259753 A1 Oct. 14, 2010

Related U.S. Application Data

(63) Continuation-in-part of application No. 12/388,805, filed on Feb. 19, 2009, and a continuation-in-part of application No. 12/254,864, filed on Oct. 21, 2008, now Pat. No. 7,918,528, and a continuation-in-part of application No. 12/079,338, filed on Mar. 25, 2008.

(51) Int. Cl.
*B41J 2/165* (2006.01)

(52) U.S. Cl. ..... 347/23; 347/19

(58) Field of Classification Search ..... 347/19, 347/23

See application file for complete search history.

(56) References Cited

U.S. PATENT DOCUMENTS

| | | | | |
|---|---|---|---|---|
| 5,621,524 | A | 4/1997 | Mitani | |
| 6,097,405 | A * | 8/2000 | Lo et al. | 347/6 |
| 6,648,444 | B2 | 11/2003 | Valero et al. | |
| 6,814,422 | B2 | 11/2004 | Bruch et al. | |
| 7,862,141 | B2 * | 1/2011 | Hayashi et al. | 347/19 |
| 7,918,528 | B2 * | 4/2011 | Govyadinov et al. | 347/19 |
| 8,201,913 | B2 | 6/2012 | Govyadinov et al. | |
| 2006/0139392 | A1 * | 6/2006 | Fernandez et al. | 347/19 |
| 2007/0024658 | A1 * | 2/2007 | Diol et al. | 347/19 |
| 2007/0064041 | A1 | 3/2007 | Sugahara | |
| 2009/0091595 | A1 | 4/2009 | Hayashi et al. | |
| 2009/0184993 | A1 * | 7/2009 | Yorimoto et al. | 347/14 |

* cited by examiner

*Primary Examiner* — Julian Huffman
*Assistant Examiner* — Sharon A Polk
(74) *Attorney, Agent, or Firm* — Steven R. Ormiston

(57) ABSTRACT

In one embodiment, a drop detection method includes: moving a light source along a first side of the drop zone to illuminate drops passing through a drop zone; and, without blocking any part of the drop zone, detecting light scattered off the drops as the drops pass through the drop zone. In another embodiment, a drop detector includes: a light source on a first side of the drop zone for illuminating drops passing through a drop zone; a light detector on the first side of the drop zone near the light source and a movable carriage carrying the light source and the light detector. The light detector is exposed to the drop zone for detecting light scattered off drops as the drops pass through the drop zone. The carriage is movable along the first side of the drop zone in a direction transverse to the drop direction.

14 Claims, 10 Drawing Sheets

DROP DETECTION

CROSS REFERENCE TO RELATED APPLICATIONS

This application is a continuation in part and claims priority from of the following co-pending U.S. patent applications: Ser. No. 12/388,805 filed Feb. 19, 2009 titled Light Scattering Drop Detector; Ser. No. 12/254,864 filed Oct. 21, 2008 now U.S. Pat. No. 7,918,528 titled Drop Detector System And Method With Light Collector; and Ser. No. 12/079,338 filed Mar. 25, 2008 titled A Drop Detection Mechanism And A Method Of Use Thereof. This application is also related to U.S. patent application Ser. No. 12/511,639 filed Jul. 29, 2009 titled Drop Detection and incorporated herein by reference in its entirety.

BACKGROUND

It is sometimes desirable to detect characteristics of ink drops ejected by an inkjet printer. Characteristics of the ink drops may be used to assess the state or "health" of structural and operational features of the printer. For example, detecting that ink drops are absent where they should be present and detecting the number, size and/or shape of ink drops may help determine whether orifices through which ink drops are ejected (or are supposed to be ejected) are partially or fully clogged.

DRAWINGS

FIG. 1 a block diagram illustrating one embodiment of an inkjet printer.

The same part numbers designate the same or similar parts throughout the figures.

DESCRIPTION

Hewlett Packard Company is developing light scattering drop detectors (LSDD) for drop detection in inkjet printers and other drop dispensing devices. One of the challenges in the development of LSDD for inkjet, and for conventional optical (ODD) and electrostatic (EDD) inkjet drop detectors as well, is providing scalability—the efficient adaptation to different printing environments. Embodiments of the present disclosure were developed in an effort to scale LSDD to page wide array (PWA) inkjet printing environments. Thus, embodiments will be described with reference to a PWA inkjet printer. Embodiments of the disclosure, however, are not limited to PWA inkjet but may be used in other printing or drop dispensing environments. The following description, therefore, should not be construed to limit the scope of the disclosure, which is defined in the claims that follow the description.

Figure 1:
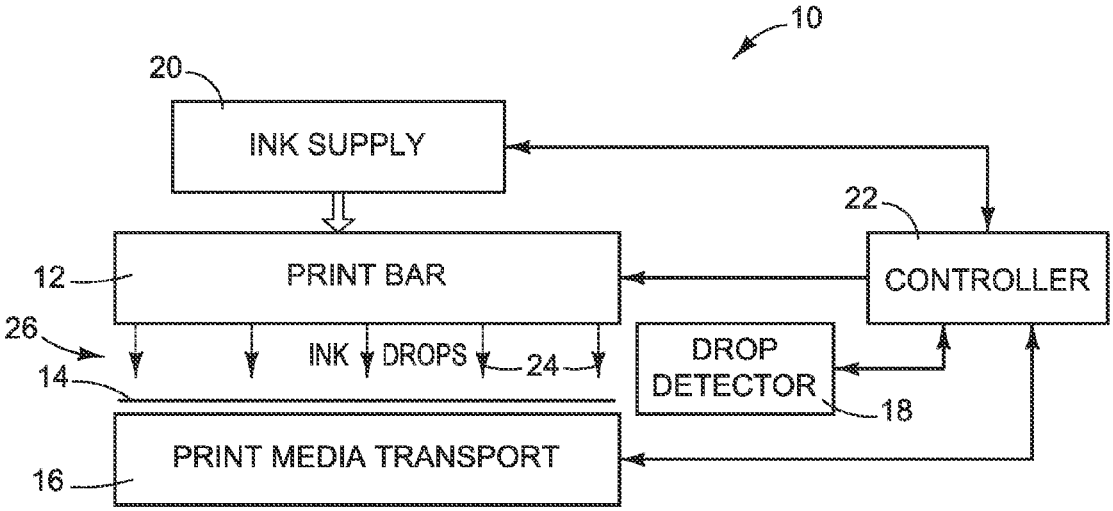

FIG. 1 is a block diagram illustrating one embodiment of an inkjet printer 10 that includes a print bar 12 spanning the width of a print media 14. Printer 10 also includes a media transport mechanism 16, a drop detector 18, an ink supply 20, and an electronic printer controller 22. Controller 22 represents generally the programming, processor(s) and associated memories, and the electronic circuitry and components needed to control the operative elements of a printer 10. Print bar 12 represents generally an array of printhead modules each carrying one or more printhead dies and the associated mechanical and electrical components for dispensing ink drops on to a sheet or web of paper or other print media 14. Print bar 12 may be a single print bar spanning media 14 or multiple print bars that together span media 14. For convenience, print bar 12 is referred to in the singular in the remainder of this Description.

A typical thermal inkjet printhead die, for example, includes an orifice plate arrayed with ink ejection orifices and firing resistors formed on an integrated circuit chip positioned behind the ink ejection orifices. The printhead die(s) in each module are electrically connected to printer controller 22 and fluidically connected to ink supply 20. In operation, printer controller 22 selectively energizes ink ejector elements in a printhead die, or group of printhead dies, in the appropriate sequence to eject ink on to media 14 in a pattern corresponding to the desired printed image. As described in more detail below, drop detector 18 includes a movable light source for illuminating ink drops 24 passing through a drop zone 26 between print bar 12 and media 14 and a light detector for detecting light scattered of drops 24. The light detector is movable in some embodiments and stationary in some embodiments.

Figure 3:
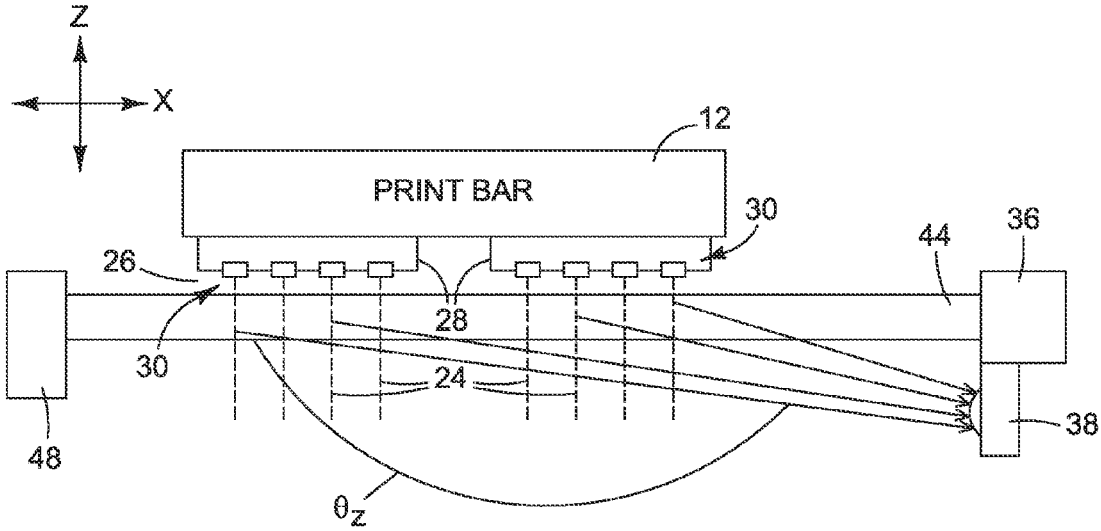
FIGS. 2 and 3 are bottom plan and end elevation views, respectively, illustrating one embodiment of a drop detector such as might be used in the printer of FIG. 1.
Figure 2:
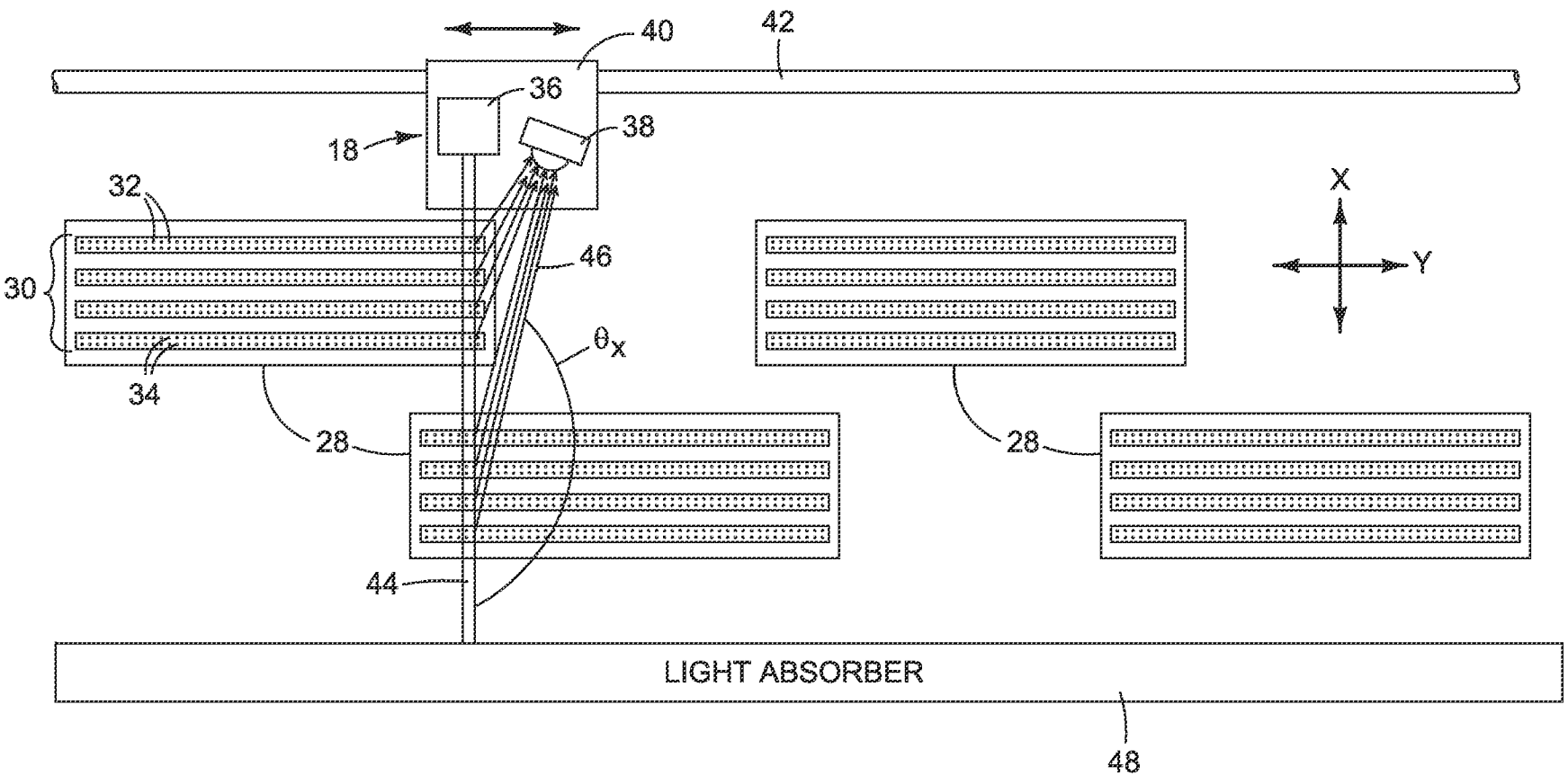

FIGS. 2 and 3 are bottom plan and end elevation views, respectively, illustrating one embodiment of a drop detector 18. For clarity, the scale of FIG. 3 is expanded compared to FIG. 2. Referring to FIGS. 2 and 3, print bar 12 includes a media wide array of four stationary printhead modules 28. Each module 28 includes one or more printhead dies for ejecting ink drops through drop zone 26 (FIG. 3). Individual printhead dies are not depicted in FIGS. 2 and 3. Ink drops 24 are ejected from the printhead die(s) on each module 28 through an array 30 of ink ejection orifices 32. In the embodiment shown, orifice array 30 consists of four pairs of rows 34 of orifices 32. The orifices 32 in each pair of rows 34, for example, may be used to eject a different color ink.

Drop detector 18 includes a light source 36 for illuminating ink drops 24 and a light detector 38 for detecting light scattered off illuminated drops 24. In the embodiment shown in FIGS. 2 and 3, light source 36 and light detector 38 are carried together on a carriage 40. Carriage 40 moves laterally on a guide rail 42 back and forth along drop zone 26 in a direction transverse to the direction media 14 moves past print bar 12 (media transport direction) and transverse to the direction drops 24 move through drop zone 26 (drop direction). In some embodiments for a printer 10 (FIG. 1) these three directions will be substantially orthogonal to one another. Thus, in the embodiment shown in FIGS. 2 and 3, the three directions may be described with reference to the X, Y and Z axes in a Cartesian coordinate system, where media 14 moves in a direction parallel to the X axis, carriage 40 moves in a direction parallel to the Y axis, and drops 24 move in a direction parallel to the Z axis. Other configurations are possible and embodiments are not limited to orthogonal directions of movement. Thus, a transverse direction for carriage 40 is across but not necessarily perpendicular to the media transport direction or to the drop direction.

With continued reference to FIGS. 2 and 3, light source 36 projects a light beam 44 through drop zone 26 at desired locations along drop zone 26, for example at the direction of controller 22 (FIG. 1). Light 46 scattered off drops 24 is detected by light detector 38. Light detector 38 outputs an electrical signal representative of scattered light 46. The signal may be analyzed, for example by controller 22 in FIG. 1, to determine characteristics of drops 24. Light in beam 44 is scattered off drops 24 in all directions. For clarity in illustrating drop detector 18, however, only light scattered back toward light detector 38 is represented by arrow lines 46. In some embodiments, drop detector 18 may include a light absorber 48 positioned along drop zone 26 opposite light source 36 light behind drops 24 to help minimize any unwanted scattering of stray light back toward detector 38. Any suitable light absorber may be used including, for example, a black material or coating with high light absorption and so-called black bodies or other such structural elements configured to absorb light.

Figure 4A:
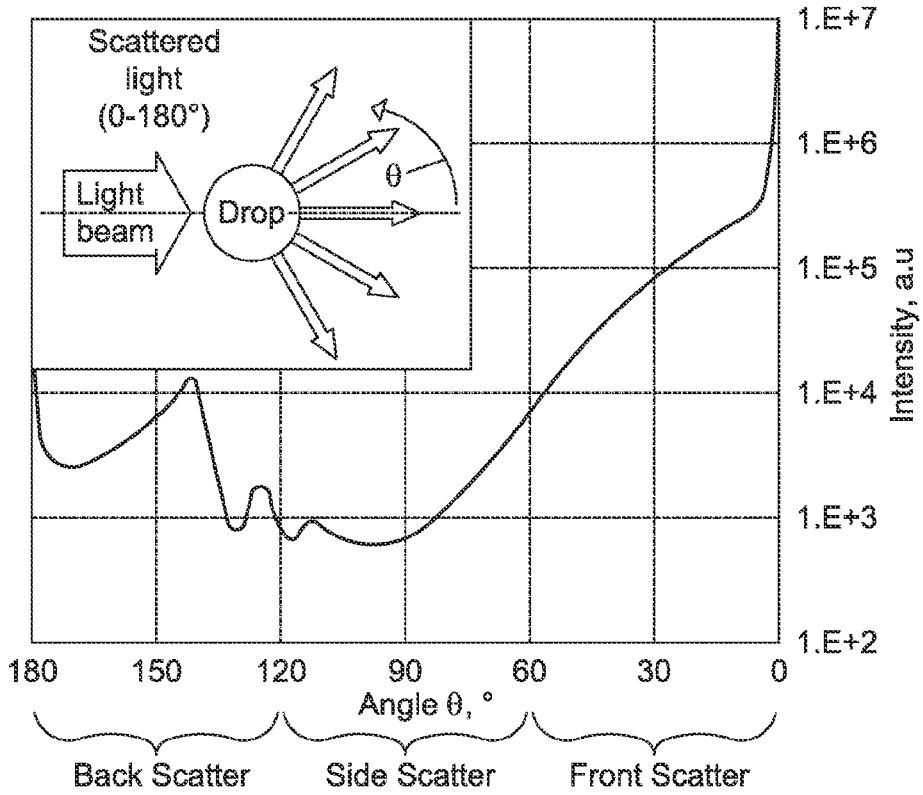
FIG. 4A is a graph illustrating the intensity of light scattered off drops as a function of the angle of scatter. The graph of FIG. 4A represents a mathematical model produced by analytical solution of the Mie equation for spherical particles.
Figure 4B:
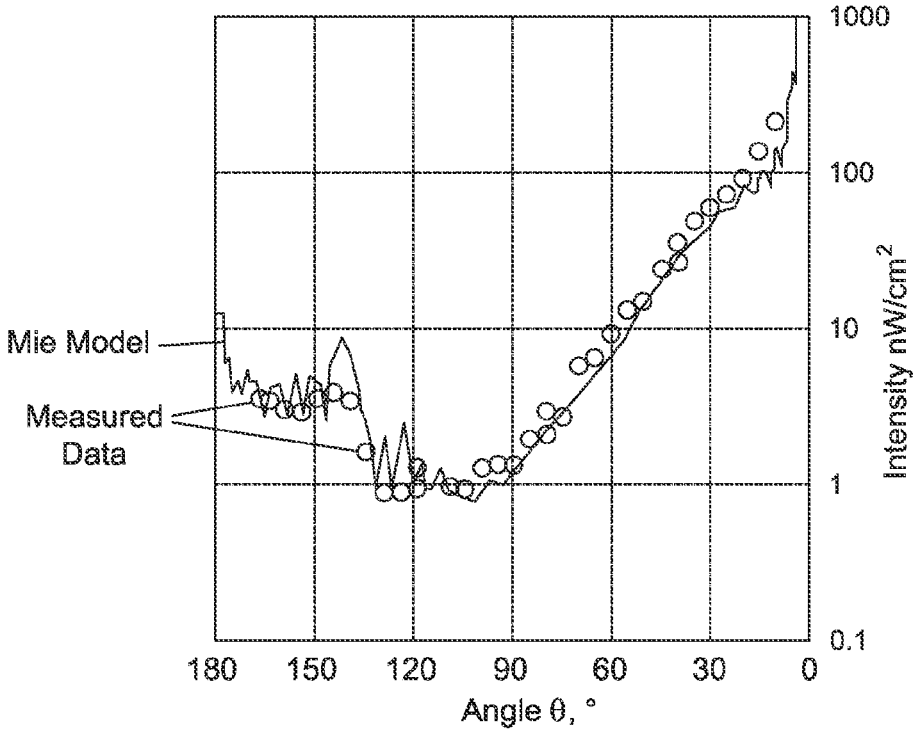
FIG. 4B is a graph illustrating the correlation between the mathematical model represented in FIG. 4A and actual measurements for drops ejected by a thermal inkjet device.
Figure 5:
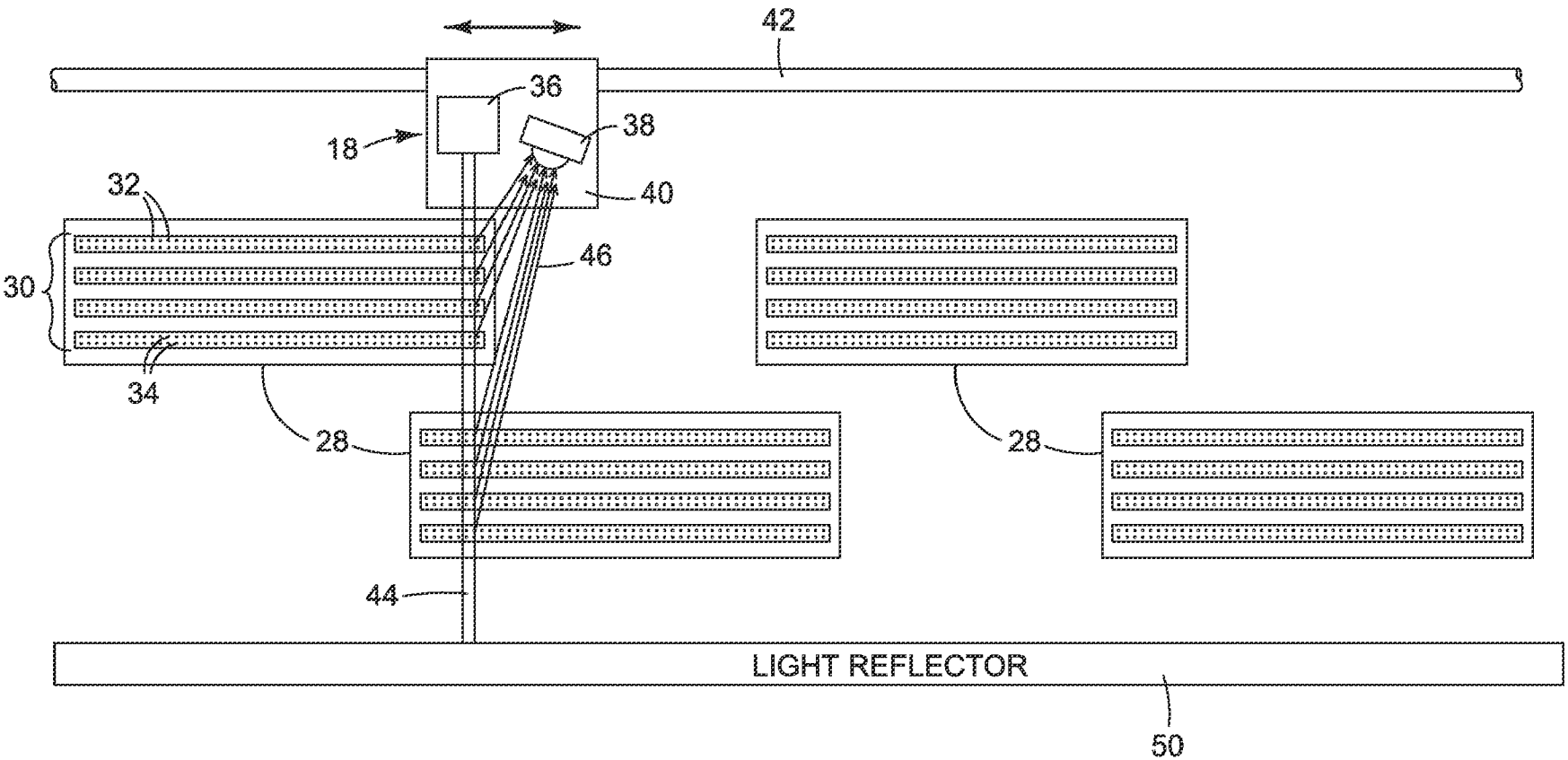
FIGS. 5-9 are bottom plan views illustrating embodiments of a drop detector such as might be used in the printer of FIG. 1.

The inventors have demonstrated that it is feasible to detect and characterize drops 24 from light scattered off drops 24 back toward light source 36 in general, and more specifically that such "back scattering" drop detection is feasible at distances comparable to those of a page wide array printer drop zone. FIG. 4A is a line graph illustrating the intensity of light scattered off drops as a function of a scatter angle θ. The single line of FIG. 4A represents a composite of the intensity of light scattered off 40 μm diameter spherical water drops illuminated with a narrow band light source at wavelengths between 405 and 850 nm. The graph of FIG. 4A is a mathematical model produced by analytical solution of the Mie equation for spherical particles. FIG. 4B shows the correlation between the mathematical model and actual measurements for 6 ng, approximately 20 μm spherical water drops ejected by a thermal inkjet device and illuminated with a 25 mW VCSEL (vertical cavity surface emitting laser) emitting an 850 nm wavelength beam about 2 mm in diameter. Scattered light was measured with a PIN diode detector about 30 mm from the drops. Scatter angle θ in FIGS. 4A and 4B represents a scatter angle $\theta_X$ in the XY plane as shown in FIG. 2 or a scatter angle $\theta_Z$ measured in the XZ plane as shown in FIG. 3. Referring specifically to FIG. 4A, the intensity of scattered light varies from $10^6$-$10^7$ a.u. (arbitrary units) at lower scatter angles θ to $10^3$-$10^4$ a.u. at higher scatter angles θ. Although the scattered light is most intense at very low scatter angles ("front" scattering, θ=0°-60°), the scattered light is sufficiently intense at higher angles, through both "side" scattering (θ=60°-120°) and "back" scattering (θ=120°-180°) zones, to detect and characterize the drops.

Back scattering drop detection enables a carriage mounted drop detector 18 that is completely outside drop zone 26. As shown in FIGS. 2 and 3, for example, there is no part of detector 18 or carriage 40 that blocks any part of drop zone 26. By contrast, in a conventional carriage mounted ODD (optical drop detector) in which the light source and light detector must be located on opposite sides of the drop zone (scatter angle θ=0°), part of the carriage and/or drop detector necessarily blocks part of the drop zone. A new carriage mounted back scattering drop detector 18 such as that shown in FIGS. 2 and 3 may be used to scan drop zone 26 without blocking any ink drops 24. Thus, no special drop ejection sequence or protocol is necessary to perform drop detection. Close alignment of the light source, drops and light detector is required for conventional ODD. Thus, a stepper motor is needed for a carriage mounted ODD to achieve the required alignment—a repeating sequence of moving the carriage, stopping the carriage, and then detecting drops. Close alignment is not critical for the new carriage mounted detector as the light beam crosses drop zone 26 and light scattered off drops 24 is detected by detector 38. Drops 24 may be detected even as carriage 40 scans light beam 44 along drop zone 26. Drop detection may be performed even during operations in which drops 24 are ejected simultaneously at locations outside the viewing area of detector 38. In addition, carriage 40, light source 36 and light detector 38 may be configured more compactly because there is no need to straddle drop zone 26, thus allowing more efficient movement of carriage 40.

Referring still to FIGS. 2 and 3, light source 36 represents generally any source of a light beam suitable for illuminating ink drops 24 including, for example, EELs (edge emitting lasers), VCSELs (vertical cavity surface emitting lasers) and LEDs (light emitting diodes). Light detector 38 represents generally any light detector suitable for detecting light scattered off ink drops 24 including, for example, PIN detectors with integrated transimpedance amplifier, or discrete PIN detectors with external transimpedance amplifier, and phototransistors.

In one embodiment, carriage 40 is moved to discrete locations along drop zone 26 where light source 36 is energized to project light beam 44 to detect drops 24 at each location. In another example, carriage 40 is scanned along drop zone 26 while light source 36 continuously projects light beam 44 to detect drops 24. A scale and encoder or other suitable position detector may be used to synchronize the movement of carriage 40 with the ejection of drops 24 and to correlate the relative positions of carriage 40 (and thus light source 36 and light detector 38) and ink drops 24 as light scattered off drops 24 is detected and the detection signals transmitted to controller 22 (FIG. 1). Scanning drop detection may be performed in multiple passes of a faster carriage scan back and forth along drop zone 26 or in one pass of a slower carriage scan along drop zone 26.

FIGS. 5-9 are bottom plan views illustrating other embodiments of a drop detector 18. In the embodiment shown in FIG. 5, drop detector 18 includes a light reflector 50 positioned along drop zone 26 opposite light source 36 behind drops 24. Reflector 50 functions as a second light source illuminating drops 24 to help increase the intensity of scattered light 46 that reaches light detector 38. Reflector 50 enables improved signal strength and signal-to-noise ratio for detector 38 by the addition of a single component. Reflector 50, a light folding mirror for example, shifts scattered light detection from just backscattering to front and back scattering with a corresponding order of magnitude signal improvement, while still maintaining the advantages of a one-sided location of for scanning carriage 40. The use of a light reflector 50 may be desirable, for example, to improve the detection of drops 24 that have greater light absorption. Black ink drops, for example, absorb significantly more light than other color ink drops. Therefore, it may be desirable in some embodiments to include a light reflector 50 to improve the accuracy of detecting black ink drops.

Figure 6:
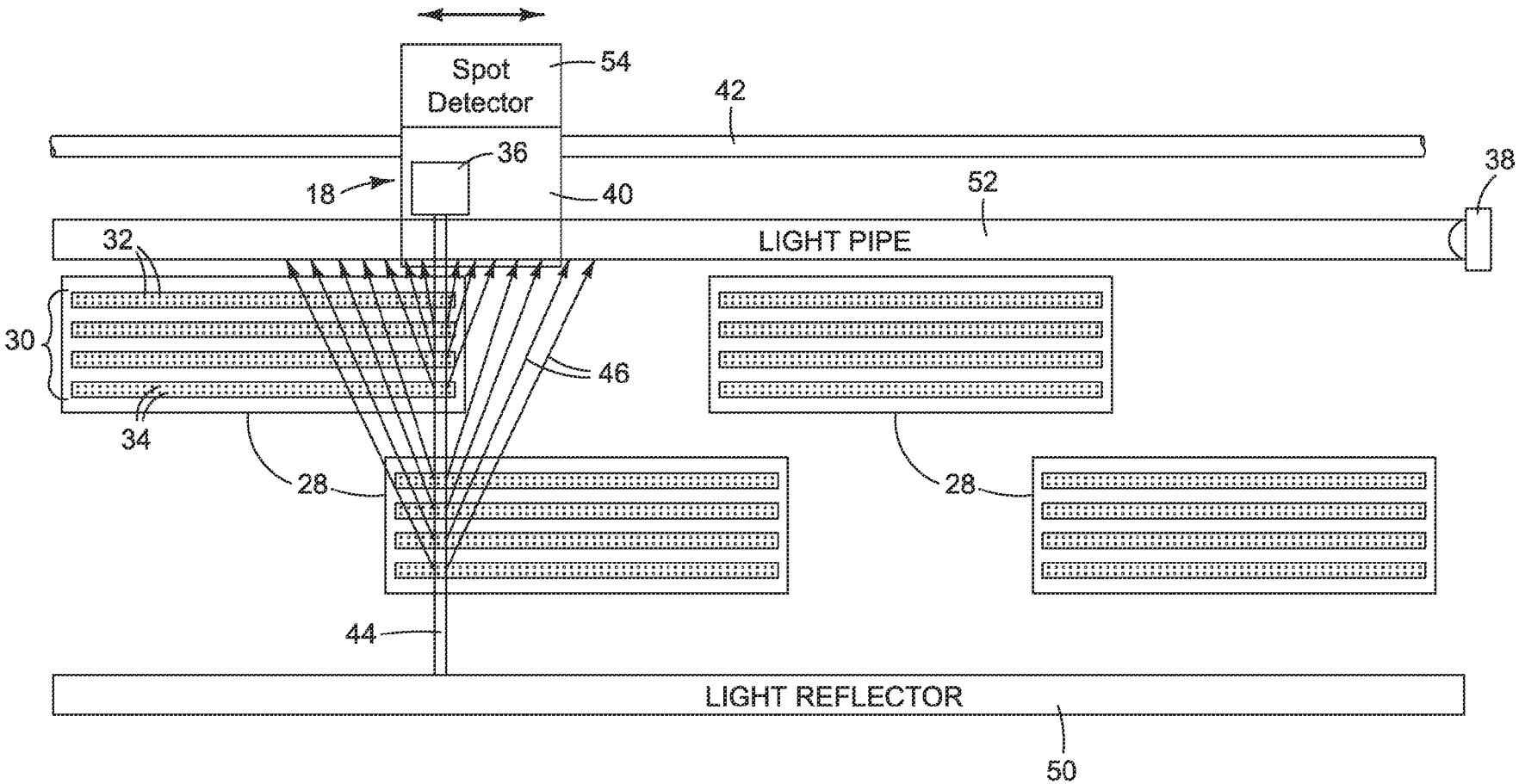

In the embodiment shown in FIG. 6, drop detector 18 includes a light pipe 52 positioned along drop zone 26 on the same side as light source 36. Light pipe 52 collects and transmits scattered light 46 to light detector 38, increasing the angle through which scattered light is detected. In the embodiment of FIG. 6, carriage 40 also carries a spot detector 54. Hewlett-Packard Company is adapting a carriage mounted spot detector, currently used in some scanning inkjet printers, for use in page wide array printers to deliver spatial information about a printed test pattern/image to the writing system for print bar alignment. This alignment procedure will be performed when a new print bar 12 or printhead module 28 is installed and only occasionally thereafter (if at all). Thus, combining elements of a drop detector 18 with the spot sensor on carriage 40 allows for better, more cost effective utilization of the carriage/scanning subsystem.

Figure 7:
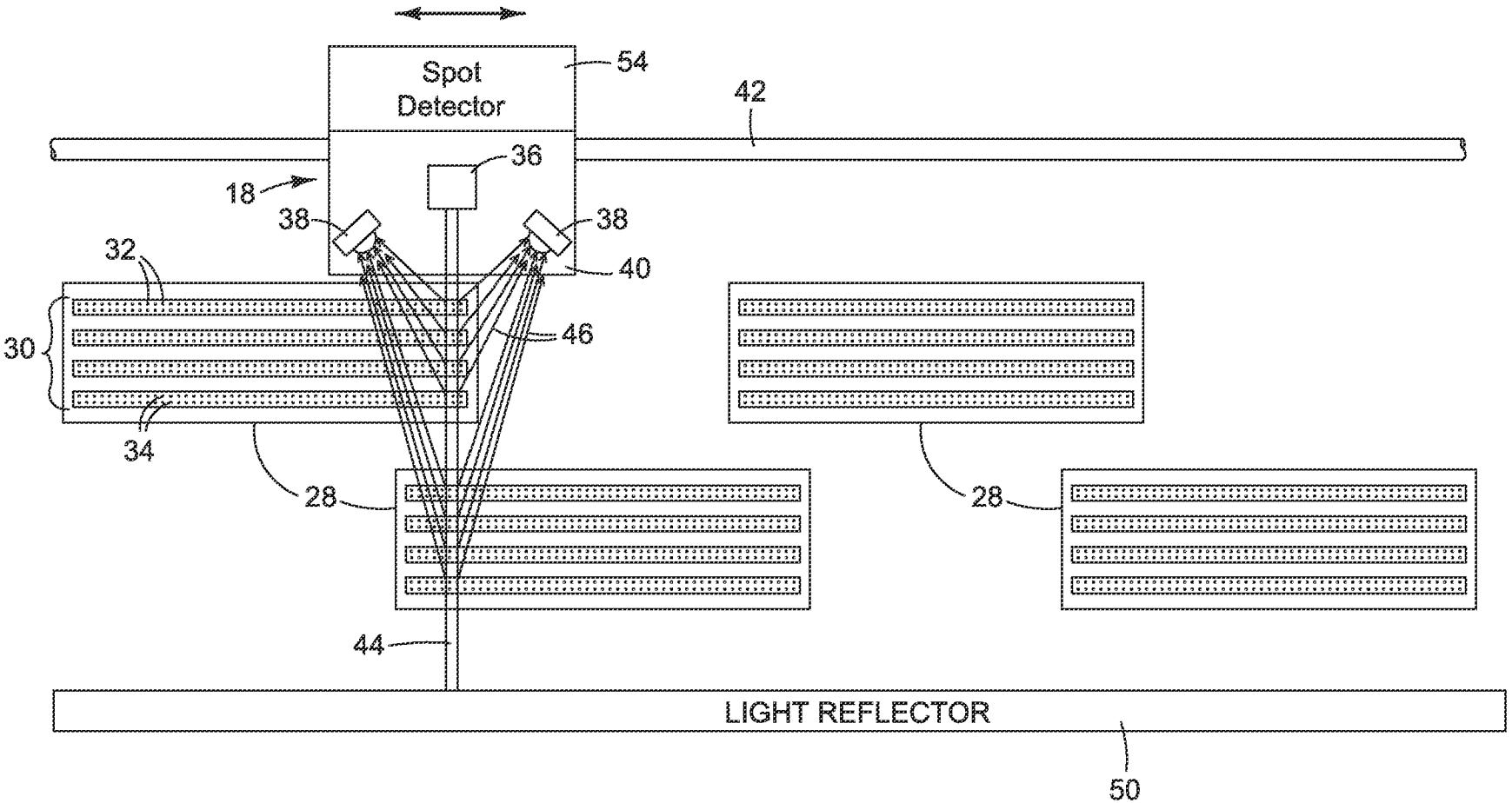
Figure 8:
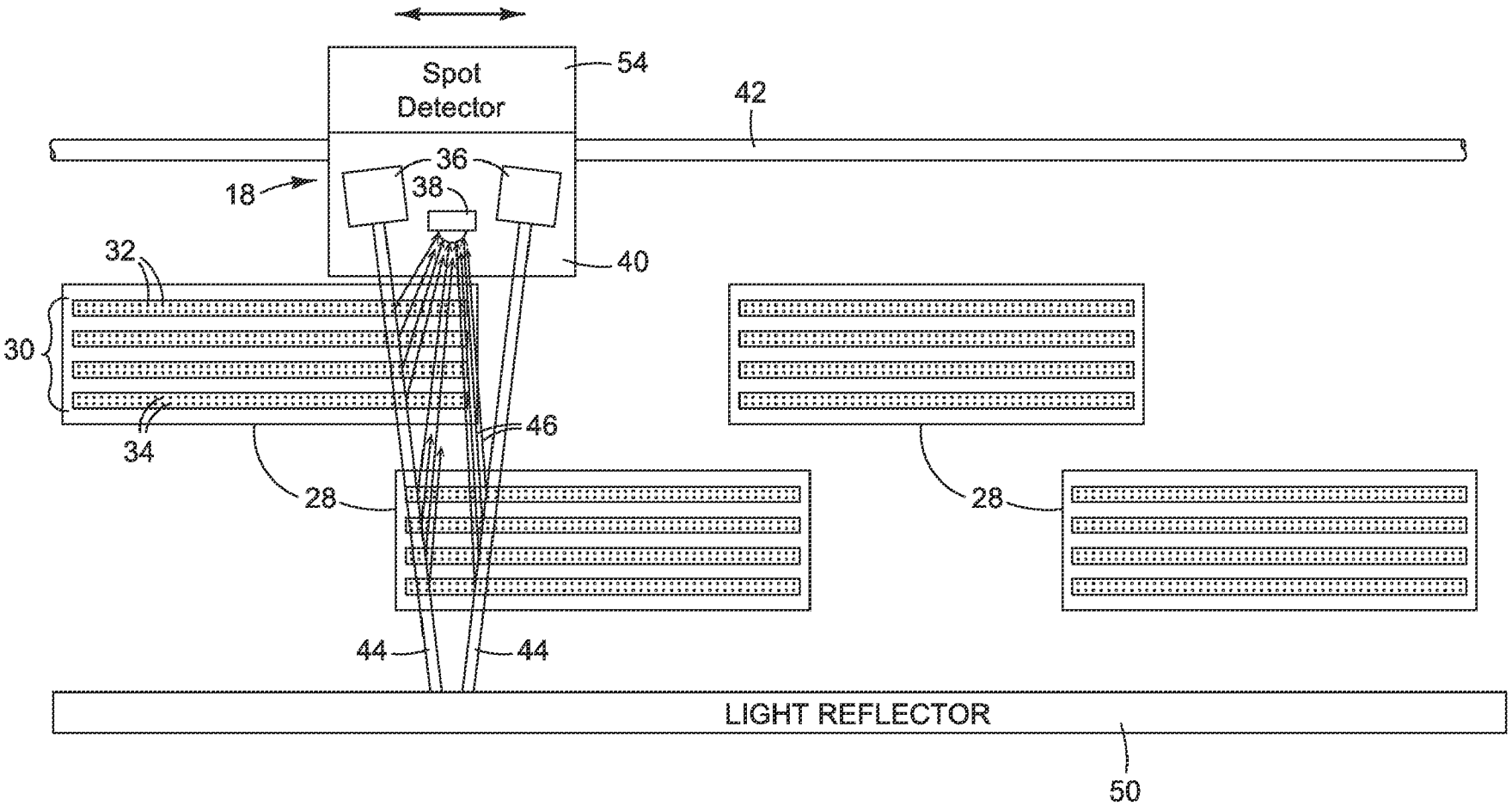

In the embodiment of FIG. 7, drop detector 18 includes two light detectors 38 carried by carriage 40 along with light source 36 and spot detector 54. Light detectors 38 are positioned on each side of light source 36. In the embodiment shown in FIG. 8, drop detector 18 includes two light sources 36 and a single light detector 38 positioned between light sources 36. The use of multiple light detectors 38 as in FIG. 7 and/or multiple light sources as in FIG. 8 helps increase the strength of the signal generated by drop detector 18.

Figure 9:
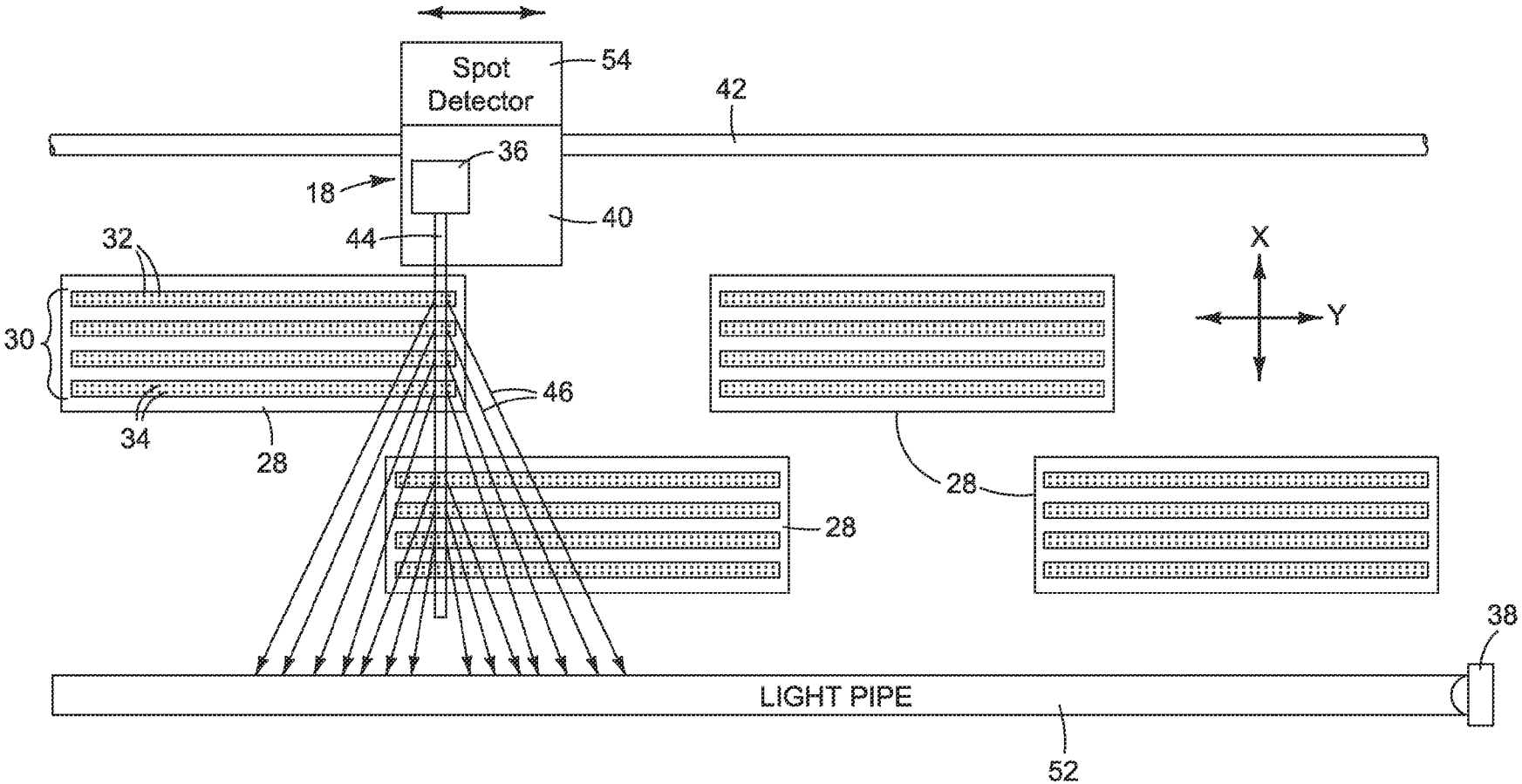

In the embodiment shown in FIG. 9, light detector 38 is positioned across drop 26 from light sensor 36. Drop detector 18 includes a light pipe 52 positioned along drop zone 26 opposite light source 36 behind drops 24. Light pipe 52 collects and transmits scattered light 46 to light detector 38. Like the back scattering drop detector 18 shown in FIGS. 2 and 3, the front scattering drop detector 18 shown in FIG. 9 enables a scanning carriage 40 (carrying light source 36) that is completely outside drop zone 26. A scanning front scattering drop detector 18 takes advantage of the higher intensity of the light 46 scattered at lower angles, but at the cost of a light pipe 52 along drop zone 26.

Figure 10:
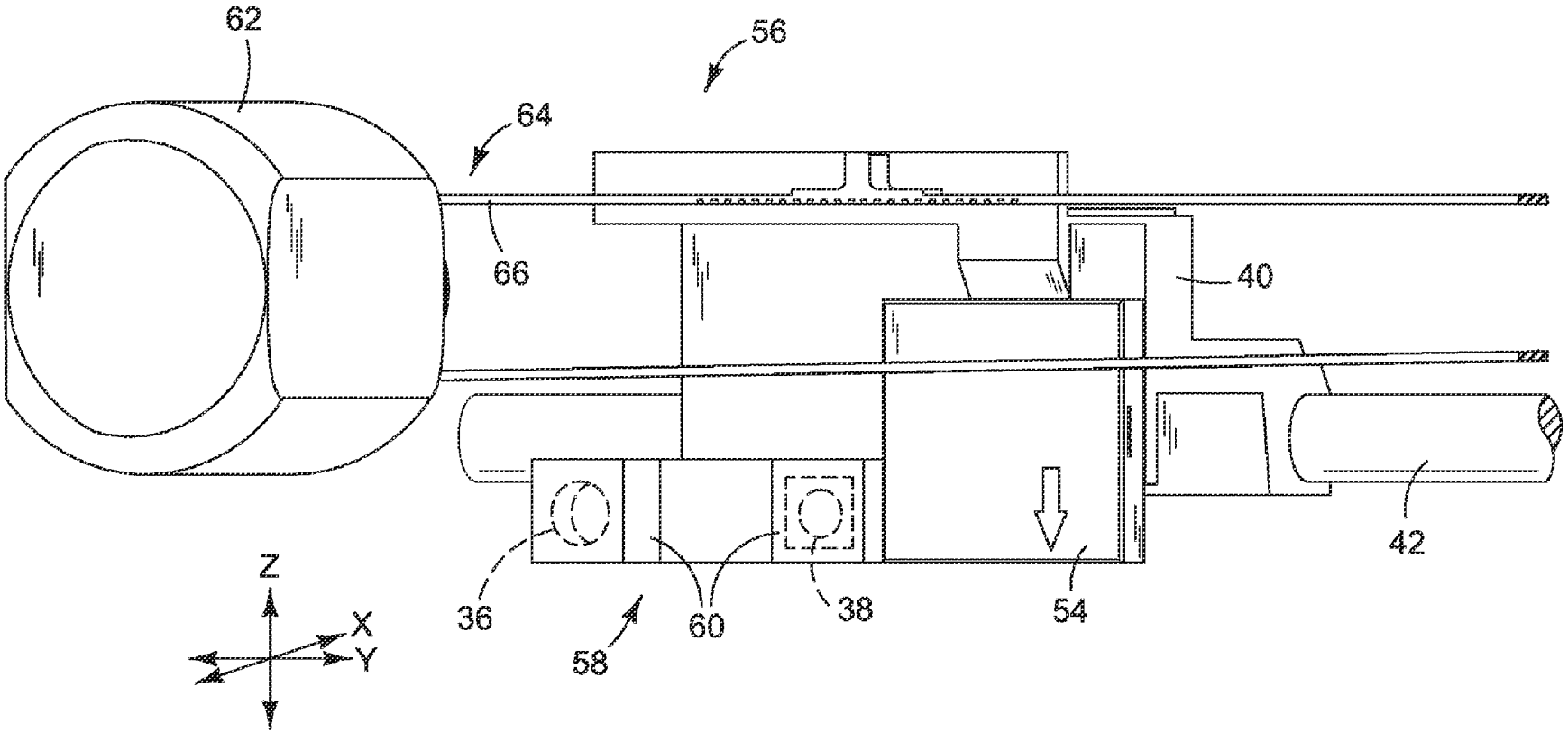
FIGS. 10 and 11 are perspective views illustrating one embodiment of a transport assembly for moving a drop detector along a drop zone.
Figure 11:
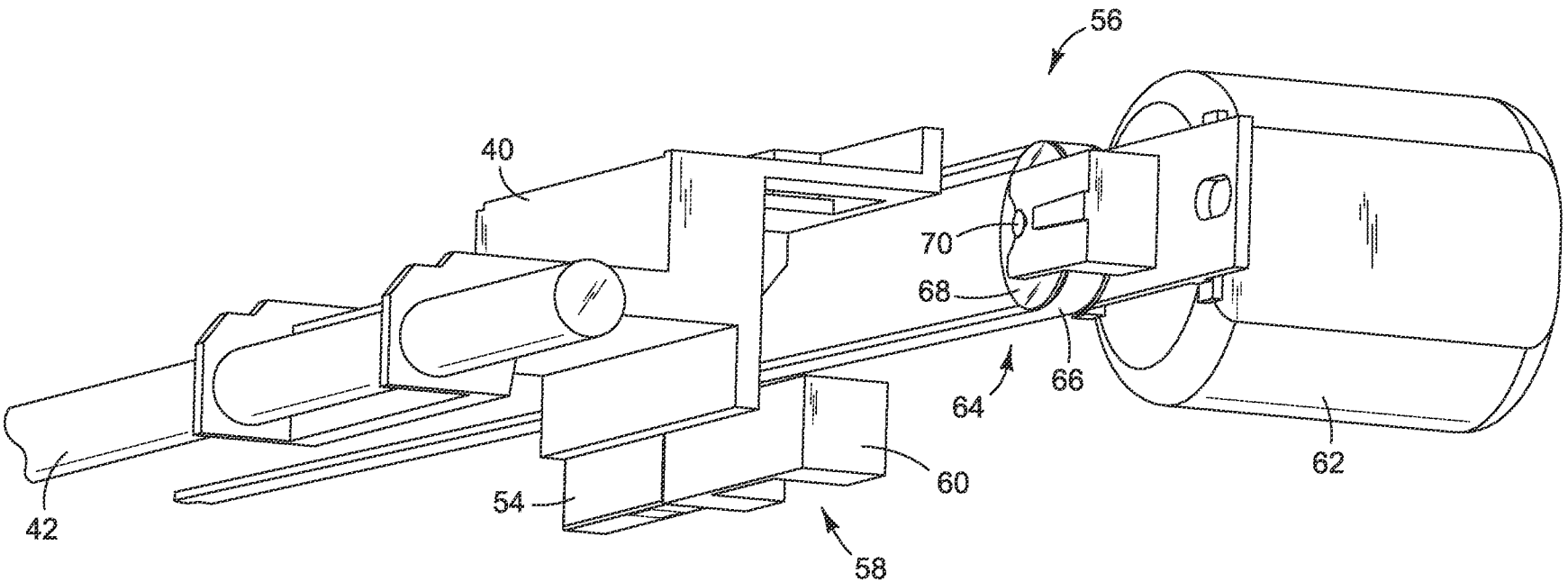

FIGS. 10 and 11 are perspective views illustrating one embodiment of a transport assembly 56 for moving carriage 40 along drop zone 26. Referring to FIGS. 10 and 11, carriage 40 carries spot detector 54, light source 36 and light detector 38. Light source 36 and light detector 38 are housed together as a single unit 58 in a housing 60 mounted to carriage 40. Motor 62 moves carriage 40 moves along guide rail 42. In the embodiment shown, carriage 40 is operatively connected to motor 62 through a drive train 64 that includes an endless loop belt 66 driven by a pulley 68 attached to a motor drive shaft 70.

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. A drop detector for detecting drops passing through a drop zone, the drop detector comprising:

a light source on a first side of the drop zone for illuminating drops passing through the drop zone, the first side being laterally adjacent to the drop zone with respect to a direction drops pass through the drop zone;

a light detector on the first side of the drop zone near the light source, the light detector exposed to the drop zone for detecting light scattered off drops as the drops pass through the drop zone; and a movable carriage carrying the light source and the light detector, the carriage movable along the first side of the drop zone in a scanning direction transverse to the drop direction.

2. The drop detector of claim 1, wherein the light detector is positioned at a scatter angle θ greater than 120° where θ represents a direction of scattered light measured with respect to an axis of a light beam from the light source with θ=0° lying along the axis in a direction of travel of the light beam and θ=180° lying along the axis opposite the direction of travel of the light beam.

3. The drop detector of claim 1, further comprising a light reflector spanning the drop zone in the scanning direction on a second side of the drop zone opposite the first side of the drop zone such that light from the light source is reflected off the reflector back through the drop zone to further illuminate drops passing through the drop zone.

4. The drop detector of claim 1, further comprising a light absorber spanning the drop zone in the scanning direction on a second side of the drop zone opposite the first side of the drop zone such that light from the light source is absorbed by the light absorber after the light has passed through the drop zone.

5. The drop detector of claim 1, further comprising a housing carried by the carriage and housing the light source and the light detector.

6. The drop detector of claim 1, further comprising a spot detector carried by the carriage for detecting a printed image on a print media passing through the drop zone.

7. The drop detector of claim 1, wherein the light source comprises more than one light source.

8. The drop detector of claim 1, wherein the light detector comprises more than one light detector.

9. The drop detector of claim 1, wherein the light detector comprises more than one light detector.

10. A drop detector for detecting drops passing through a drop zone, the drop detector comprising:

a movable light source and a movable light detector located near one another on the same side laterally adjacent to the drop zone with respect to a direction drops pass through the drop zone, the light source configured to illuminate drops passing through the drop zone and the light detector configured to detect light scattered off drops as the drops pass through the drop zone; and a movable carriage carrying the light source and the light detector, the carriage movable along the drop zone in a scanning direction transverse to a drop direction.

11. A drop detector, comprising:

a light source operable to emit a light beam for illuminating drops passing through a drop zone;

a light detector positioned near the light source to detect light scattered off the drops back toward the light source at a scatter angle theta in the range of 135° to 180°, where 8 represents a direction of scattered light measured with respect to an axis of the light beam with theta=0° lying along the axis in a direction of travel of the light beam and 8=180° lying along the axis opposite the direction of travel of the light beam; and a movable carriage carrying the light source and the light detector without blocking any part of the drop zone, the carriage movable along the drop zone in a scanning direction transverse to a drop direction.

12. The drop detector of claim 11, further comprising a single housing carried by the carriage and housing the light source and the light detector.

13. The drop detector of claim 11, further comprising a spot detector carried by the carriage for detecting a printed image on a print media passing through the drop zone.

14. The drop detector of claim 11, wherein the light source comprises more than one light source.

* * * * *

UNITED STATES PATENT AND TRADEMARK OFFICE

CERTIFICATE OF CORRECTION

PATENT NO. : 8,376,506 B2
APPLICATION NO. : 12/511583
DATED : February 19, 2013
INVENTOR(S) : Matthew A Shepherd et al.

It is certified that error appears in the above-identified patent and that said Letters Patent is hereby corrected as shown below:

In the Claims

In column 6, line 46, in Claim 11, delete "8" and insert -- θ --, therefor.

In column 6, line 49, in Claim 11, delete "8=180°" and insert -- θ=180° --, therefor.

Signed and Sealed this
Twenty-eighth Day of May, 2013

Teresa Stanek Rea
*Acting Director of the United States Patent and Trademark Office*